US005977847A

United States Patent [19]

Takahashi

[11] Patent Number: 5,977,847

[45] Date of Patent: Nov. 2, 1999

[54] MICROSTRIP BAND ELIMINATION FILTER

[75] Inventor: Kuniharu Takahashi, Tokyo, Japan

[73] Assignee: NEC Corporation, Tokyo, Japan

[21] Appl. No.: 09/013,599

[22] Filed: Jan. 26, 1998

[30] Foreign Application Priority Data

Jan. 30, 1997 [JP] Japan ..... 9-016778

[51] Int. Cl.[6] ..... H01P 1/203

[52] U.S. Cl. ..... 333/204; 333/246

[58] Field of Search ..... 333/203–205, 333/219, 246

[56] References Cited

U.S. PATENT DOCUMENTS

| | | | |
|---|---|---|---|
| 3,343,069 | 9/1967 | Tsuda | 333/204 X |
| 3,875,538 | 4/1975 | Minet et al. | 333/204 |
| 4,074,214 | 2/1978 | Aichholzer | 333/204 |
| 4,999,596 | 3/1991 | Nakatani et al. | 333/204 |

FOREIGN PATENT DOCUMENTS

| | | | |
|---|---|---|---|
| 47-10517 | 4/1972 | Japan . | |
| 57-10507 | 1/1982 | Japan . | |
| 59-101502 | 6/1984 | Japan . | |
| 59-212001 | 11/1984 | Japan . | |
| 61-219201 | 9/1986 | Japan . | |
| 63-212201 | 9/1988 | Japan . | |
| 64-44601 | 2/1989 | Japan . | |
| 2-131601 | 5/1990 | Japan . | |
| 2-152302 | 6/1990 | Japan . | |
| 4-306004 | 10/1992 | Japan . | |
| 5-183306 | 7/1993 | Japan . | |
| 1297137 | 3/1987 | U.S.S.R. | 333/204 |

*Primary Examiner*—Seungsook Ham
*Attorney, Agent, or Firm*—Young & Thompson

[57] ABSTRACT

A microstrip band elimination filter is disclosed, that comprises a microstrip main line 1 that is bend in a rectangular shape, and ¼λ stubs 2, 3, and 4 that are vertically connected to the microstrip main line 1 at intervals of ¼λ, the edge of each of the ¼λ stubs 2, 3, and 4 being bent.

12 Claims, 5 Drawing Sheets

MICROSTRIP BAND ELIMINATION FILTER

BACKGROUND OF THE INVENTION

1. Field of the Invention

The present invention relates to a band elimination filter used in a microwave band, in particular, to a band elimination filter composed of a microstrip line.

2. Description of the Related Art

An example of a conventional microstrip band elimination filter is shown in FIG. 4. Referring to FIG. 4, ¼λ stubs are vertically disposed on a microstrip main line at intervals of ¼λ. In other words, in FIG. 4, three ¼λ open stubs 11, 12, and 13 are connected to a microstrip main line 10 at intervals of ¼λ so as to form a three-staged microstrip band elimination filter. This microstrip band elimination filter is disclosed in for example Japanese Patent Laid-open Publication No. 57-10507. In addition, another microstrip band elimination filter is disclosed in Japanese Patent Laid-open Publication No. 63-212201 as a second related art reference of the present invention. In the second related art reference, a ¼λ resonator is field-coupled with a microstrip main line so as to form a band elimination filter.

As shown in FIG. 4, in the conventional microstrip band elimination filter, ¼λ stabs are vertically disposed on a microstrip main line. The ¼λ stubs and the microstrip main line are formed on a dielectric substrate. In this structure, the area of the portion other than the pattern of the band elimination filter is large. Thus, although the drawback of the structure of the three-staged band elimination filter shown in FIG. 4 is not remarkable, as the number of stages increases, the area of the band elimination filter becomes large.

Consequently, the size and weight of the band elimination filter cannot be reduced.

SUMMARY OF THE INVENTION

An object of the present invention is to provide a band elimination filter having a microstrip main line and ¼λ stubs that are bent and disposed on a dielectric substrate so as to reduce the size of the band elimination filter and improve band elimination characteristics thereof.

A first aspect of the present invention is a microstrip band elimination filter, comprising a microstrip main line that is bend in a rectangular shape, and ¼λ stubs that are vertically connected to the microstrip main line at intervals of ¼λ., the edge of each of the ¼λ stubs being bent.

A second aspect of the present invention is a microstrip band elimination filter, comprising n (where n is an odd number that is 3 or larger) ¼λ stubs, and a microstrip main line to which the n ¼λ stubs are connected at intervals of ¼λ., wherein the microstrip main line is symmetrically bent with respect to one of the n ¼λ stubs so that the length of each rectangular bend of the microstrip main line is ¼λ., (n−2) rectangular bends being connected, and wherein the n ¼λ stubs are vertically connected to the microstrip main line from the center of each of the rectangular bends and from a point ¼λ apart from each of the rectangular bends, an edge of each of the n ¼λ stubs being bent.

The microstrip band elimination filter is disposed on a dielectric substrate.

The microstrip main line is a strip line.

The direction of the bend of each of the n ¼λ stubs is the direction of which adjacent two of the ¼λ stubs are oppositely disposed.

These and other objects, features and advantages of the present invention will become more apparent in light of the following detailed description of a best mode embodiment thereof, as illustrated in the accompanying drawings.

DESCRIPTION OF PREFERRED EMBODIMENTS

Figure 1A:
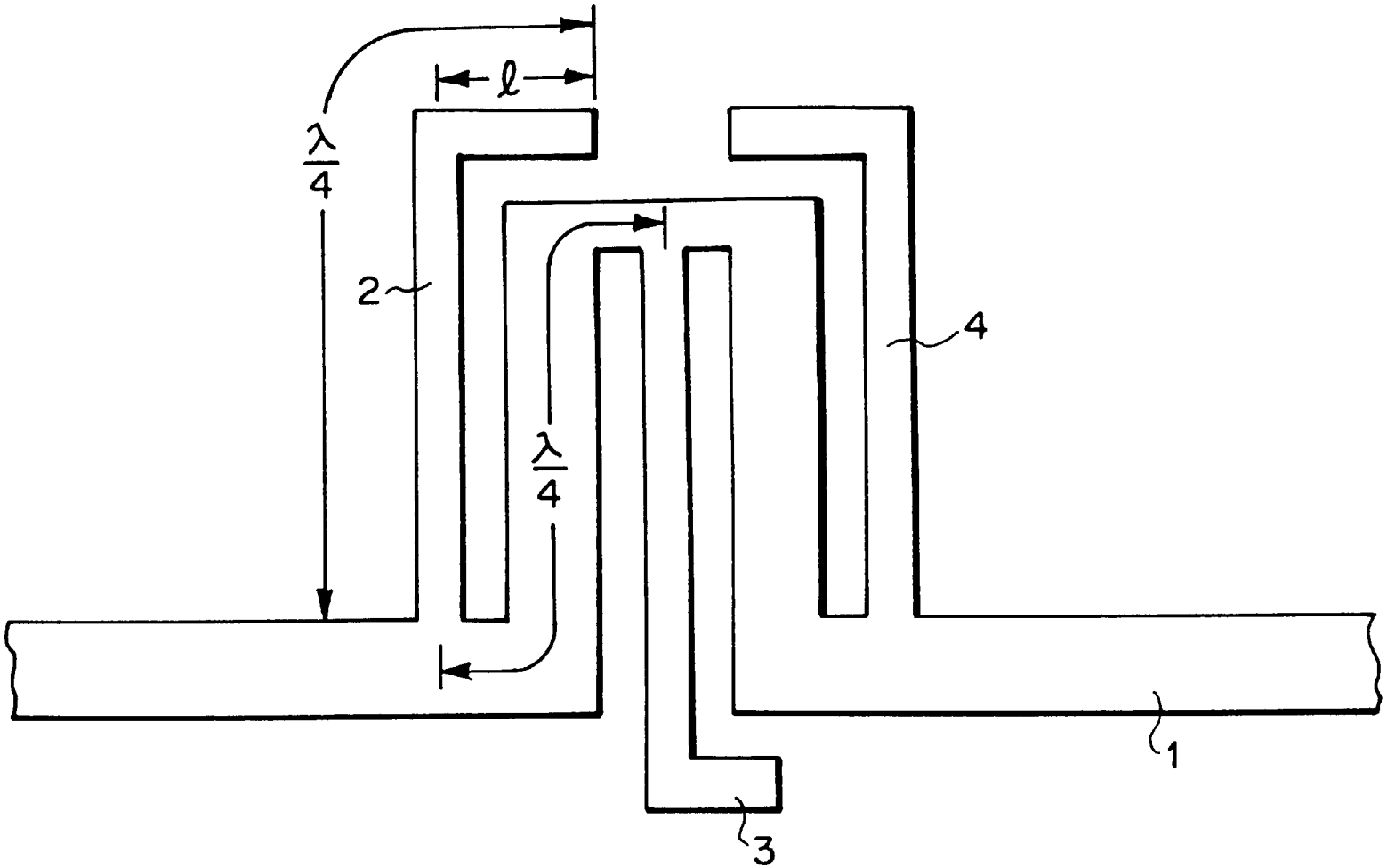
FIGS. 1*a* and 1*b* are a schematic diagram showing the structure of a three-staged band elimination filter and a dimension diagram according to an embodiment of the present invention.

An embodiment of the present invention will be described, with reference to the accompanying drawings. FIG. 1*a* is a schematic diagram showing the structure of a microstrip band elimination filter. In FIG. 1, for simplicity, the structure of a three-staged band elimination filter is shown.

Figure 4:
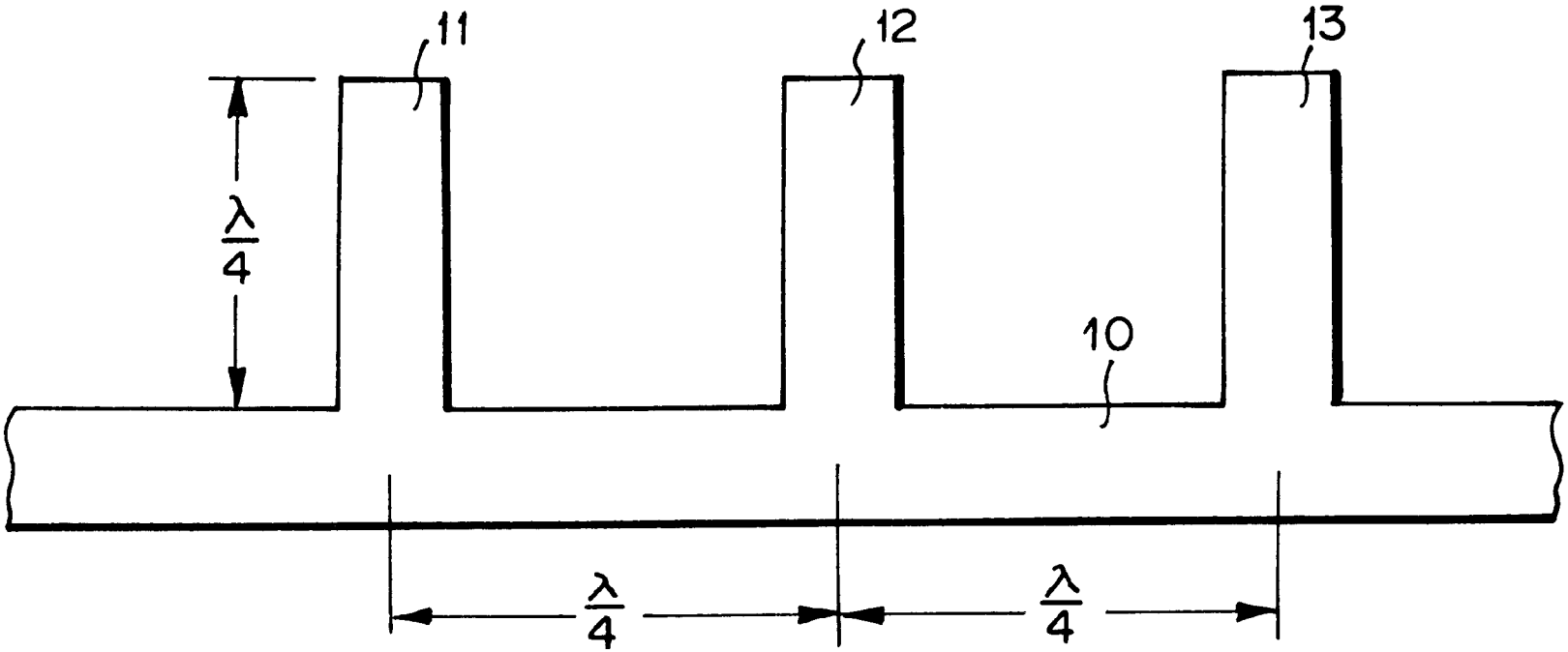
FIG. 4 PRIOR ART
FIG. 4 is a schematic diagram showing the structure of a conventional microstrip band elimination filter.

In FIG. 1*a*, as with a characteristic of the structure shown in FIG. 4, three ¼λ stubs 2, 3, and 4 that have a band elimination frequency are disposed on a dielectric substrate. Each of the ¼λ stubs 2, 3, and 4 has the length of ¼λ and is bent at the position 1 from the respective edge. The stubs 2, 3, and 4 are disposed at intervals of ¼λ according to a microstrip main line 1. The length l of the bent stubs 2, 3 and 4 respectively is about 1/16λ to ⅛λ.

Figure 1B:
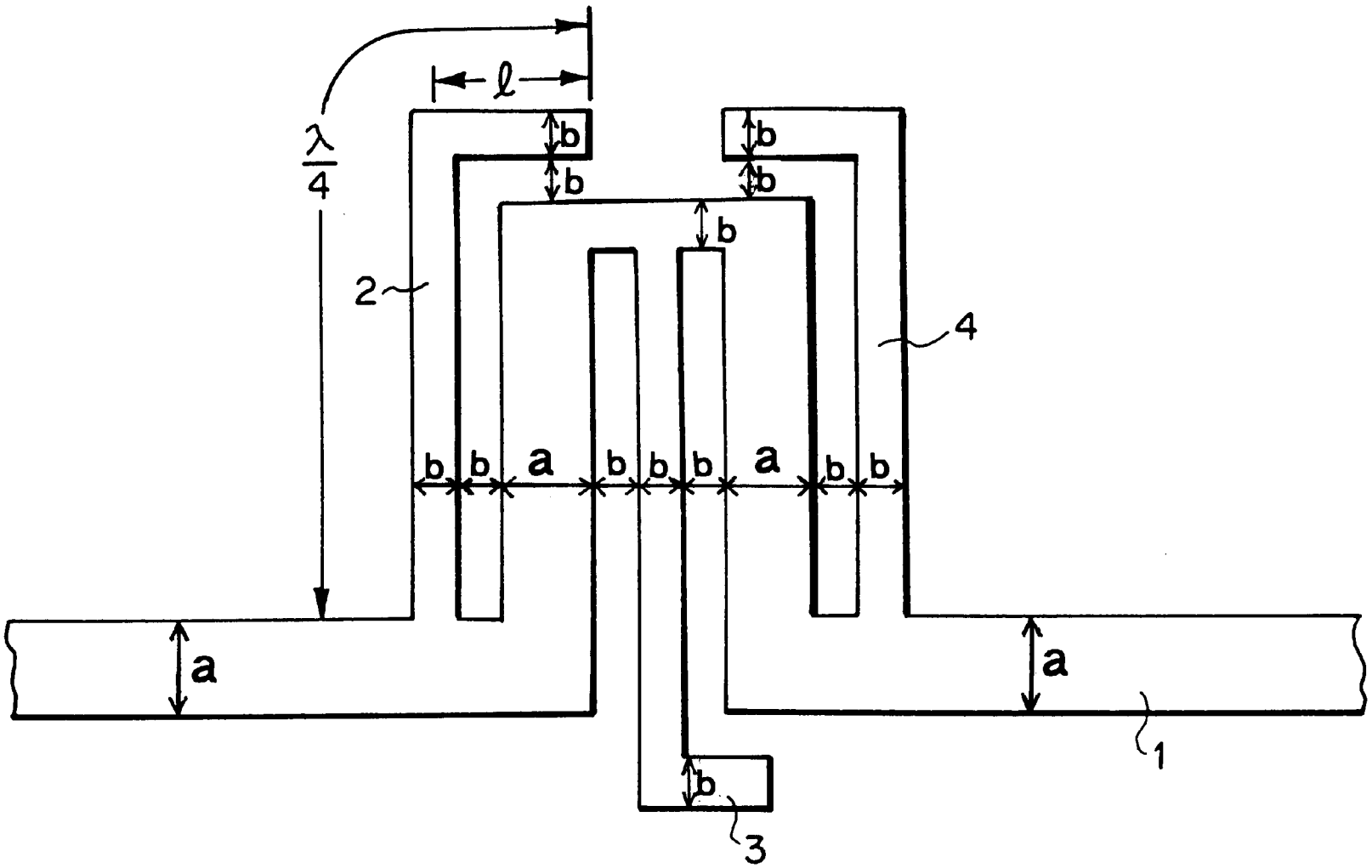

In FIG. 1*b*, the microstrip main line 1 has the width of a, the stub 2, 3 and 4 have the width of b, and a relation of the widths of a and b is b=a/2 to a. For example, the copper microstrip on a polytetrafluorethylene (Teflon) board has a thickness of 18 μm, the width a of 2 mm for supposing the impedance 50 Ωat a 4 GHz to 6 GHz signal.

On the other hand, the microstrip main line 1 is not in a straight pattern, but bent in a rectangular shape in such a manner that the microstrip main line 1 surrounds the ¼λ stubs 2, 3, and 4 (hereinafter referred to as stubs) and that the stubs 2, 3, and 4 are disposed in parallel with the microstrip main line 1. Further, the length between a connection point with the stub 2 and the microstrip main line 1 and a connection point with the stub 3 and the microstrip main line 1 is ¼λ. Furthermore, the length between a connection point with the stub 3 and the microstrip main line 1 and a connection point with the stub 4 and the microstrip main line 1 is ¼λ.

In this case, the stubs 2, 3, and 4 are preferably bent in such a manner that the edges of the stubs 2 and 4 are oppositely disposed.

Figure 2:
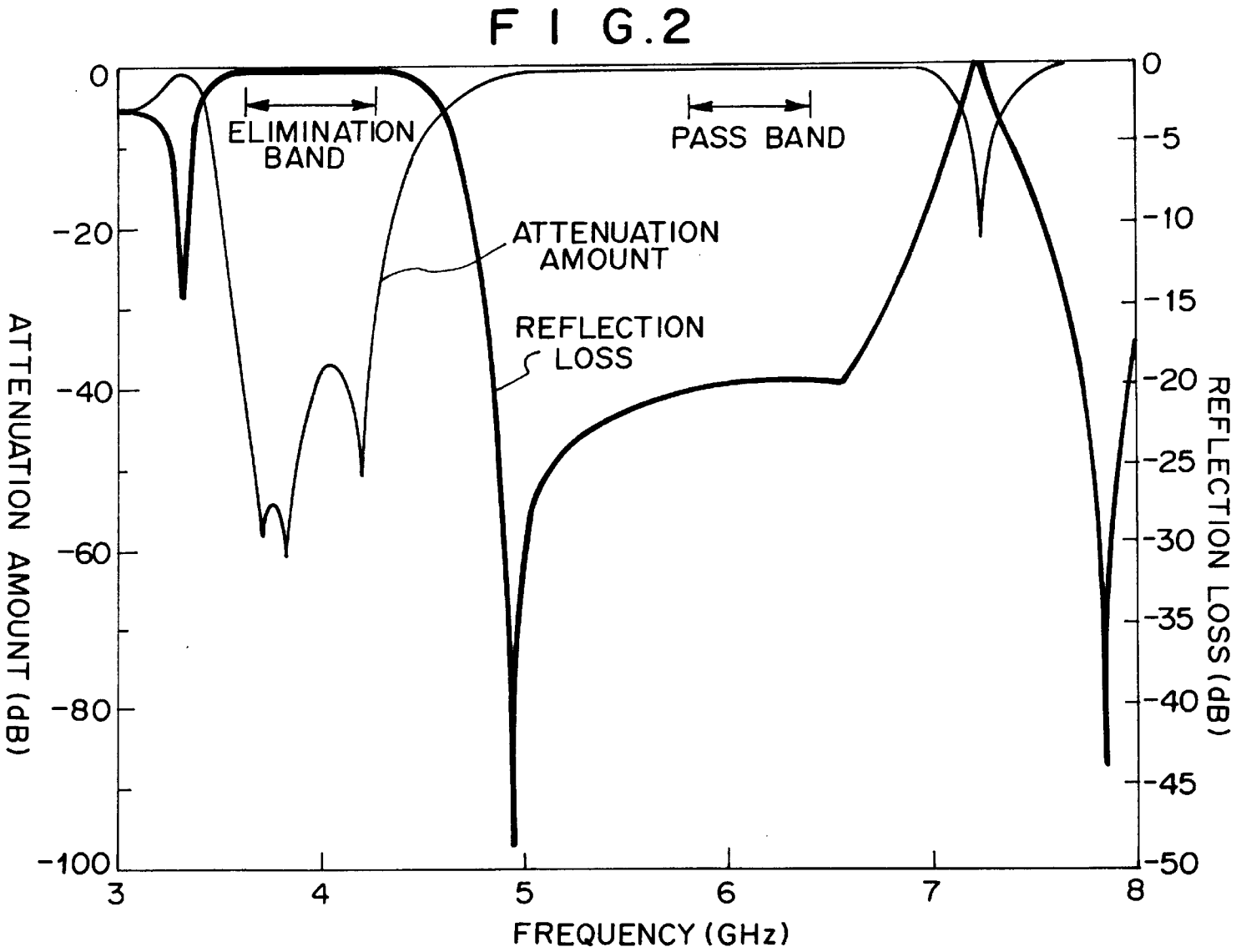
FIG. 2 is a graph showing attenuation—frequency characteristic and reflection loss—frequency characteristic of the structure shown in FIG. 1.

FIG. 2 is a graph showing a reflection loss—frequency characteristic and an attenuation amount—frequency characteristic of the three-staged band elimination filter disposed in a rectangular shape as shown in FIG. 1*a*. In the graph shown in FIG. 2, the main line 1 and the stubs 2, 3, and 4 are designated so that a 4-GHz elimination band and a 6-GHz pass band are obtained. Although the main line 1 and the stubs 2, 3 and 4 are formed in a rectangular shape, they are almost not affected by the field-coupling thereof. In addition, the elimination band is as wide as 1 GHz at the center of 4 GHz. Moreover, the reflection loss of the pass band is as small as 1 dB (max). Assuming that the elimination band is 4 GHz, ¼λ is about 14 mm as a dielectric constant ratio $\epsilon r=2.55$ of the Teflon board.

Figure 3:
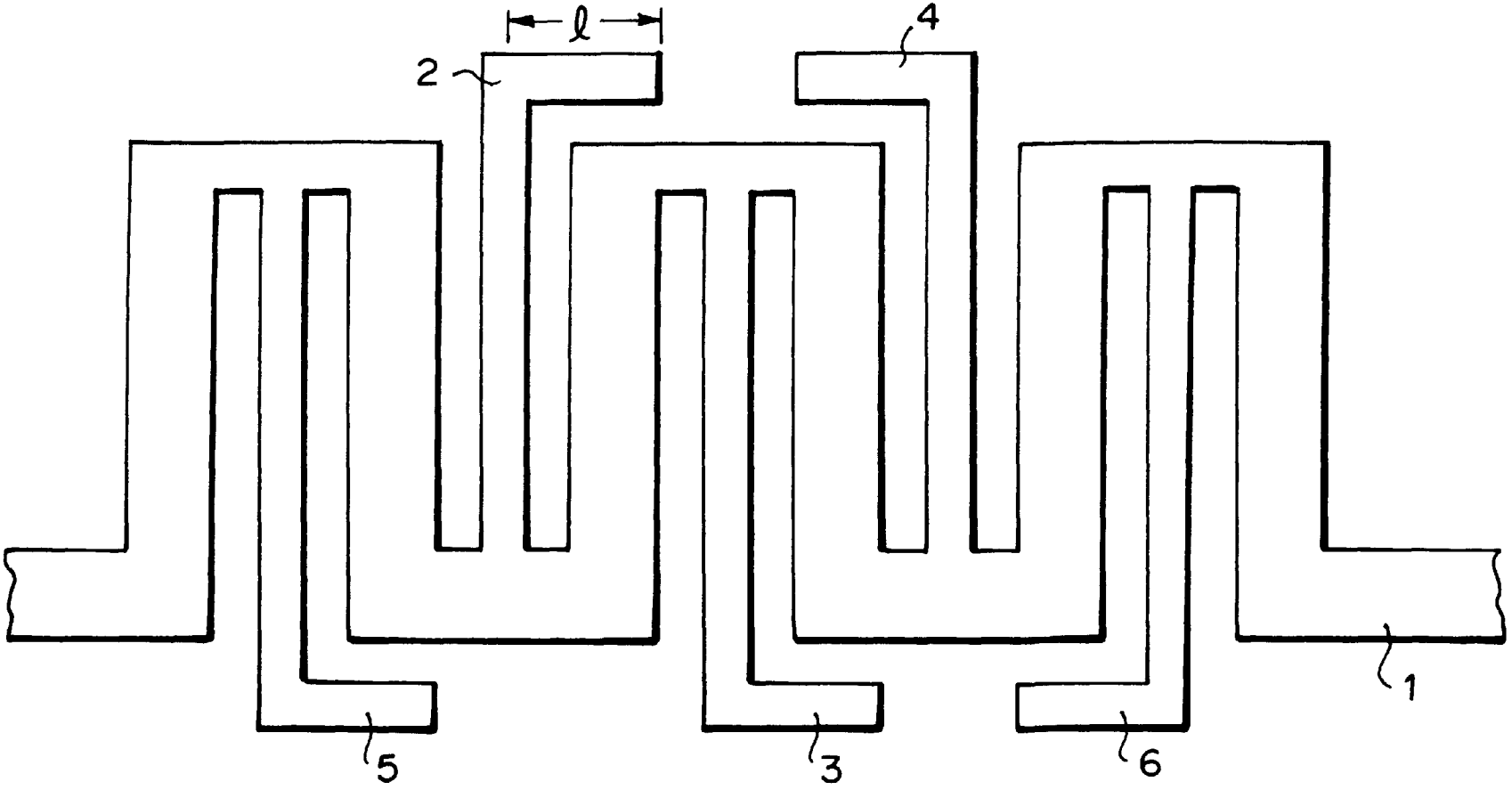
FIG. 3 is a schematic diagram showing the structure of a five-staged band elimination filter according to another embodiment of the present invention.

In the band elimination filter according to the present invention, when the number of stages is increased, the effect of the size reduction becomes large. FIG. 3 shows the structure in the case that the band elimination filter according to the present invention is formed in five stages. The structures of the main line 1 and the stubs 2, 3, and 4 shown in FIG. 3 are the same as that shown in FIG. 1. However, in the embodiment shown in FIG. 3, since the number of stages is five, stubs 5 and 6 are additionally disposed. The lengths of the stubs 2 to 6 are all ¼λ. To simplify the structures of the stubs 2 to 6, they are bent at the position l from the respective edges. The main line 1 is formed in a rectangular shape so as to surround the stubs 5 and 6. Assuming that the length l is λ/16, the height of the rectangle of the main line 1 is around λ/8. Thus, the size of the resultant structure can be reduced.

In addition, as described earlier, when the edge of the stub 6 is opposite to the edge of the stub 3, the size of the band elimination filter can be reduced.

As described earlier, when the ¼λ stubs shown in FIG. 1 are disposed in parallel with the main line 1 in the microstrip band elimination filter, the space thereof can be effectively used. In addition, even if the ¼λ stubs 2, 3, and 4 shown in FIG. 1 and FIG. 4 are disposed in parallel with the main line 1 in such a manner that the distance between each of the stubs 2, 3, and 4 and the main line 1 is small, the field-coupling thereof does not much affect the characteristics of the microstrip band elimination filter. In other words, the band elimination filter can have excellent characteristics.

In the above description, microstrip lines were described. However, it should be noted that the present invention can be applied to strip lines.

In comparison with the conventional microstrip band elimination filters, in the microstrip band elimination filters according to the present invention, since the main line and ¼λ stubs in respective stages are disposed in a rectangular shape, the filter area can be reduced. Thus, the microstrip band elimination filter can be effectively integrated. In particular, the size of the band elimination filter with many stages can be effectively reduced.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A microstrip band elimination filter, comprising:

a microstrip main line which is bent in a rectangular shape; and

¼λ stubs which are vertically connected to said microstrip main line at intervals of ¼λ, the edge of each of said ¼λ stubs being bent, wherein a width of each of said ¼λ stubs is (½) a to a when a width of said microstrip main line is a.

2. The microstrip band elimination filter as set forth in claim 1, wherein said microstrip band elimination filter is disposed on a dielectric substrate.

3. The microstrip band elimination filter as set forth in claim 1, wherein said microstrip main line is a strip line.

4. A microstrip band elimination filter, comprising;

an odd number n, which is 3 or larger, of ¼λ stubs; and a microstrip main line to which said ¼λ stubs are connected at intervals of ¼λ, wherein said microstrip main line is symmetrically bent with respect to one of said ¼λ stubs so that the length of each rectangular bend of said microstrip main line is ¼λ, (n−2) rectangular bends being connected, and wherein said ¼λ stubs are vertically connected to said microstrip main line from the center of each of the rectangular bends and from a point ¼λ apart from each of the rectangular bends, an edge of each of said ¼λ stubs being bent, and wherein a width of each of said ¼λ stubs is (½) a to a when a width of said microstrip gain line is a.

5. The microstrip band elimination filter as set forth in claim 4, wherein said microstrip band elimination filter is disposed on a dielectric substrate.

6. The microstrip band elimination filter as set forth in claim 4, wherein said microstrip main line is a strip line.

7. The microstrip band elimination filter as set forth in claim 4, wherein the direction of the bend of each of said ¼λ stubs is the direction of which adjacent two of said ¼λ stubs are oppositely disposed.

8. The microstrip band elimination filter as set forth in claim 5, herein said microstrip main line is a strip line.

9. A microstrip band elimination filter, comprising:

a microstrip main line comprising plural main line portions;

said main line portions comprising a central portion terminated with first and second rectangular bend portions of approximately equal length;

each of said first and second rectangular bend portions terminating with first and second microstrip stubs, respectively;

said first rectangular bend portion having a width approximately ½ a width at said second rectangular bend portion;

said first and second microstrip stubs having a width approximately equal to the width of said first rectangular bend portion;

a first part of said first microstrip stub running adjacent and parallel to said central portion and a second part of said first microstrip running adjacent and parallel to said second rectangular bend portion; and a first part of said second microstrip stub running adjacent and parallel to said central portion and a second part of said second microstrip stub running adjacent and parallel to said first rectangular bend portion.

10. The microstrip band elimination filter as set forth in claim 9, wherein said microstrip band elimination filter is disposed on a dielectric substrate.

11. The microstrip band elimination filter as set forth in claim 9, wherein said microstrip main line is a strip line.

12. The microstrip band elimination filter of claim 9, wherein said first part of said first microstrip stub is spaced apart from said central portion by a distance equal to the width of said first part of said second microstrip stub.

* * * * *